US009708111B1

(12) United States Patent
Prince

(10) Patent No.: US 9,708,111 B1
(45) Date of Patent: Jul. 18, 2017

(54) PACKAGING SHEET FOR BOX OR WRAPPING

(71) Applicant: Jennifer Prince, San Jose, CA (US)

(72) Inventor: Jennifer Prince, San Jose, CA (US)

( * ) Notice: Subject to any disclaimer, the term of this patent is extended or adjusted under 35 U.S.C. 154(b) by 0 days.

(21) Appl. No.: 15/383,761

(22) Filed: Dec. 19, 2016

(51) Int. Cl.

| | |
|---|---|
| ***B65D 5/00*** | (2006.01) |
| ***B65D 65/02*** | (2006.01) |
| ***B65D 5/02*** | (2006.01) |
| ***B65D 5/42*** | (2006.01) |

(52) U.S. Cl.
CPC ..... *B65D 65/02* (2013.01); *B65D 5/02* (2013.01); *B65D 5/4266* (2013.01)

(58) Field of Classification Search
CPC ..... B65D 65/02; B65D 5/4266; B65D 5/10; B65D 5/0227; B65D 5/0236
USPC ..... 229/115, 110, 108, 122.34, 132, 136, 229/198.2
See application file for complete search history.

(56) References Cited

U.S. PATENT DOCUMENTS

| | | | | |
|---|---|---|---|---|
| 2,365,704 | A | 1/1942 | James | |
| 2,761,611 | A * | 9/1956 | Benschoter | B65D 5/10 229/110 |
| 2,826,350 | A * | 3/1958 | Marx | B65D 5/0254 229/110 |
| 4,392,601 | A * | 7/1983 | Fujikawa | B23K 37/047 228/4.1 |
| 5,337,943 | A | 8/1994 | Hendren | |
| 5,542,597 | A | 8/1996 | Richards | |
| 5,971,264 | A | 10/1999 | Karahoca | |
| 6,187,403 | B1 | 2/2001 | Richardson | |
| 6,604,674 | B1 | 8/2003 | Bowman | |
| 7,690,554 | B2 * | 4/2010 | Zacher | B65D 5/0227 229/109 |
| 8,783,546 | B2 | 7/2014 | Uyehara | |
| 9,365,337 | B2 | 6/2016 | Fullan | |
| 2003/0111521 | A1 | 6/2003 | Holmes | |
| 2006/0180642 | A1 * | 8/2006 | Zacher | B65D 5/0227 229/109 |
| 2007/0059477 | A1 | 3/2007 | Perelman et al. | |

* cited by examiner

*Primary Examiner* — Christopher Demeree
(74) *Attorney, Agent, or Firm* — Haynes and Boone, LLP

(57) ABSTRACT

A packaging sheet for wrapping an article or object, providing structure around the article or object, or forming a box. The packaging sheet includes first, second, third, fourth, and fifth flaps connected to first, second, third, fourth, and fifth panels along first, second, third, fourth, and fifth edges, respectively. The second panel is connected to the first panel, the third panel is connected to the first panel opposite the second panel, the fourth panel is connected to the second panel opposite the first panel, and the fifth panel is connected to the third panel opposite the first panel. The second and third flaps each define a distal edge extending at an angle relative to the second and third edges, respectively. The second and third flaps each define a first triangular shape or a first trapezoidal shape.

40 Claims, 8 Drawing Sheets

PACKAGING SHEET FOR BOX OR WRAPPING

CROSS-REFERENCE TO RELATED APPLICATION

This application is related to U.S. Design application Ser. No. 29/588,242, filed Dec. 19, 2016, the entire disclosure of which is hereby incorporated herein by reference.

TECHNICAL FIELD

This disclosure relates in general to reusable gift packaging and, in particular, to a packaging sheet for a box or wrapping (e.g., a reusable gift box or reusable gift wrapping paper).

BACKGROUND

A gift, or present, is packaged inside a box, which box is then wrapped in a decorative wrapping material such as, for example, paper, plastic, or another fibrous or polymeric sheet material. The box may be in the shape of a rectangular prism. A sheet of the decorative wrapping material is measured and cut to match the size of the box. The decorative wrapping paper is then secured around the box using, for example, tape strips, and folded at opposing ends thereof to fully conceal the box. The box and decorative wrapping material operate to conceal the gift until such time as the recipient chooses to remove the decorative wrapping material and open the box. However, in some cases, packaging a gift in the manner described is inefficient in time and natural resources and, especially where the giver has limited gift packaging experience, leads to a low quality finished product having defects (e.g., torn or crumpled wrapping material). These difficulties are exacerbated when packaging multiple gifts, because the decorative wrapping material must be measured, cut, and folded to the correct size for each box. Additionally, the decorative wrapping material is not designed to be reused after the recipient opens the gift, but is instead meant to be immediately discarded. Therefore, what is needed is a method, apparatus, or kit that addresses one or more of these issues, and/or other issues.

DETAILED DESCRIPTION

Figure 1:
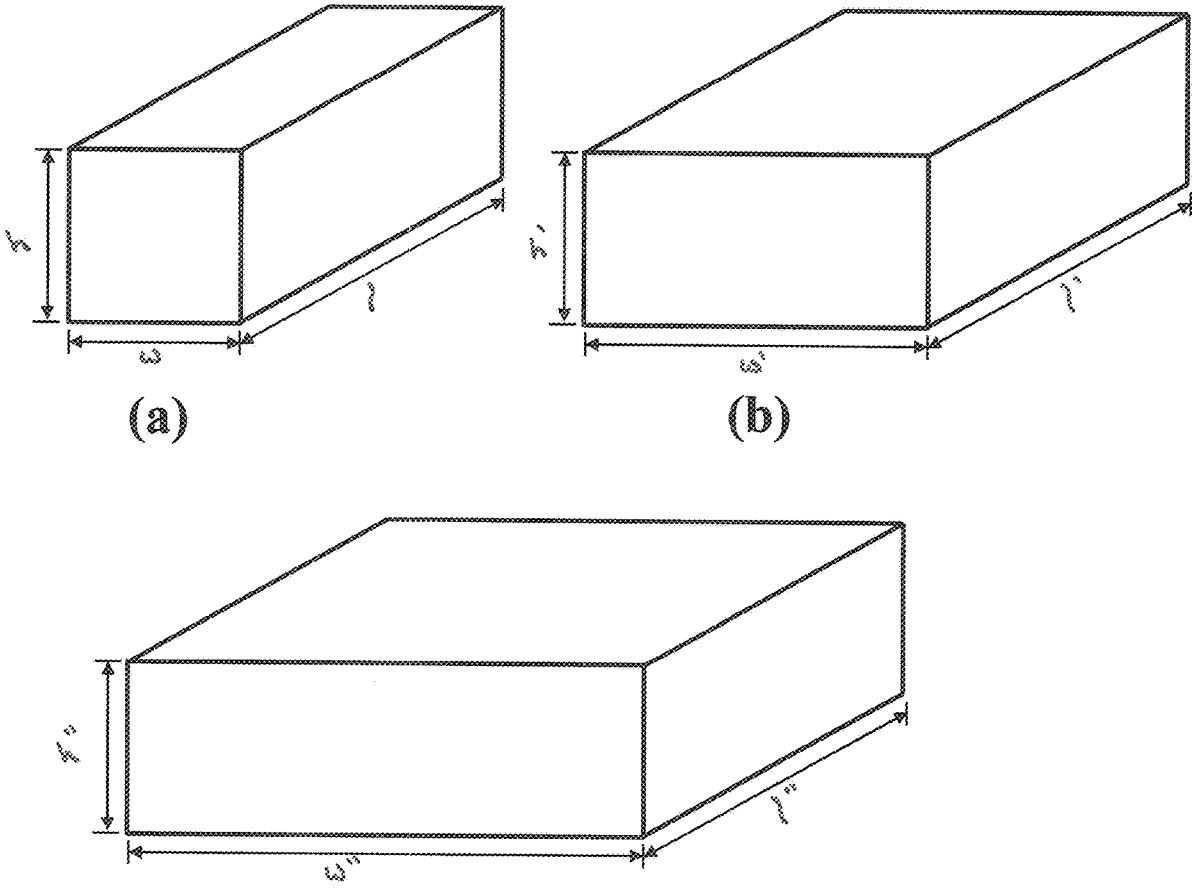
FIGS. 1(*a*)-(*c*) are perspective views of three (3) different shaped structures (e.g., boxes or other articles or objects) that are each adapted to be wrapped, or formed by a packaging sheet, according to an exemplary embodiment.

FIGS. 1(*a*)-(*c*) illustrate three (3) different-shaped structures (e.g., boxes or other articles or objects) that are each adapted to be wrapped, or formed, by a packaging sheet. A systematic or mathematical pattern is used to mark or cut the packaging sheet(s) according to the shape and size of a gift to be packaged. Alternatively, the packaging sheet(s) may be pre-cut (or pre-marked) in accordance with the disclosed systematic or mathematical pattern. The packaging sheet(s) are sized to efficiently wrap around an article or object, provide structure around the article or object, or form a box having a standard predetermined size such as, for example, the structures (e.g., boxes or other articles or objects) shown in FIGS. 1(*a*)-(*c*). The dimensions of the packaging sheet(s) are predetermined based on the dimensions of the article or object to be wrapped or structurally enclosed, or the box to be formed, as will be discussed in further detail below. In several exemplary embodiments, one or more of the packaging sheet(s) of FIGS. 2 and 5-8 are foldable along the dashed lines to wrap the article or object, provide structure around the article or object, or form the box. In several exemplary embodiments, one or more of the packaging sheet(s) of FIGS. 2 and 5-8 are scored along the dashed lines to better facilitate the folding of the packaging sheet(s) along the dashed lines.

In particular, FIG. 1(*a*) illustrates the dimensions of an article or object to be wrapped or structurally enclosed, or a box to be formed, by a packaging sheet, said dimensions including a length l, a width w, and a height h. In the embodiment of FIG. 1(*a*), the width w is approximately equal to the height h (i.e., $w \approx h$). The packaging sheets described below with reference to FIGS. 2-4, 7, and 8 can be made to fit (or form) any size article, object, or box where the width w is approximately equal to the height h (i.e., $w \approx h$) such as, for example, the article, object, or box shown in FIG. 1(*a*). In several exemplary embodiments, the dimensions of the packaging sheet of FIGS. 2-4 can be altered to work on an article, object, or box where the width w is greater than the height h and less than (or equal to) two-times the height h (i.e., $h < w \leq 2\ h$).

Further, FIG. 1(*b*) illustrates the dimensions of an article or object to be wrapped or structurally enclosed, or a box to be formed, by another packaging sheet, said dimensions including a length l', a width w', and a height h'. In the embodiment of FIG. 1(*b*), the width w' is approximately two-times the height h' (i.e., $w' \approx 2\ h'$). The packaging sheet described below with reference to FIG. 5 can be made to fit any size article, object, or box where the width w' is approximately two-times the height h' (i.e., $w' \approx 2\ h'$) such as, for example, the article, object, or box shown in FIG. 1(*b*). In several exemplary embodiments, the dimensions of the packaging sheet of FIG. 5 can be altered to work on an article, object, or box where the width w' is greater than the height h' and less than (or equal to) two-times the height h' (i.e., h'<w'≤2 h').

Finally, FIG. 1(*c*) illustrates the dimensions of an article or object to be wrapped or structurally enclosed, or a box to be formed, by yet another packaging sheet, said dimensions including a length l", a width w", and a height h". In the embodiment of FIG. 1(*c*), the width w" is approximately three-times the height h" (i.e., w"≈3 h"). The packaging sheet described below with reference to FIG. 6 can be made to fit any size article, object, or box where the width w" is approximately three-times the height h" (i.e., w"≈3 h") such as, for example, the article, object, or box shown in FIG. 1(*c*). In several exemplary embodiments, the dimensions of the packaging sheet of FIG. 6 can be altered to work on any article, object, or box where the width w" is greater than two-times the height h" (i.e., w">2 h").

Figure 2:
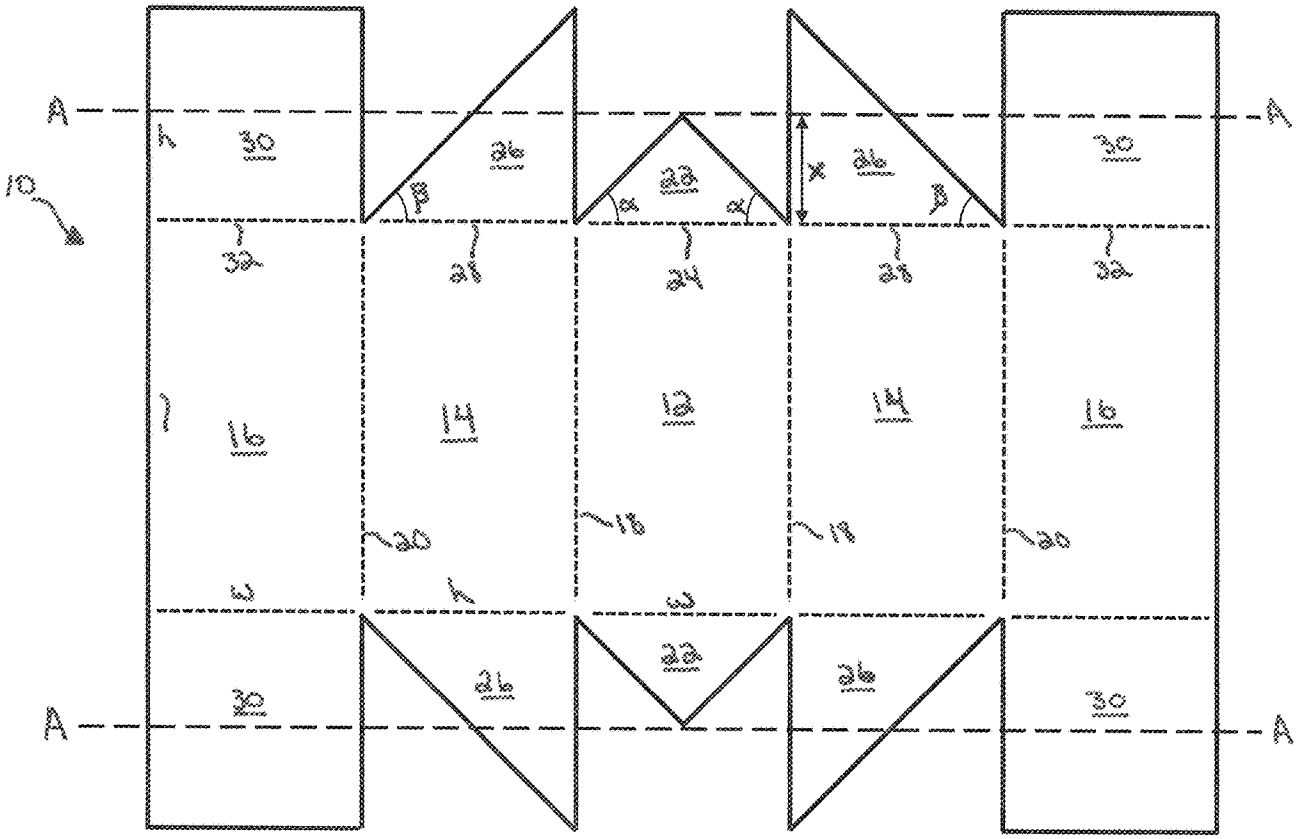
FIG. 2 is a plan view of a packaging sheet adapted to wrap the article or object, provide structure around the article or object, or form the box, of FIG. 1(*a*), according to an exemplary embodiment.
Figure 3:
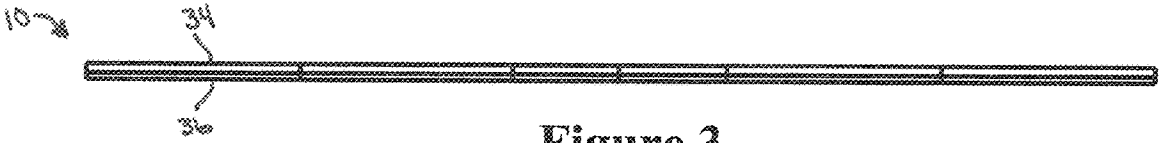
FIG. 3 is an elevational view of the packaging sheet of FIG. 2, the packaging sheet including a base layer and a laminate layer, according to an exemplary embodiment.
Figure 4:
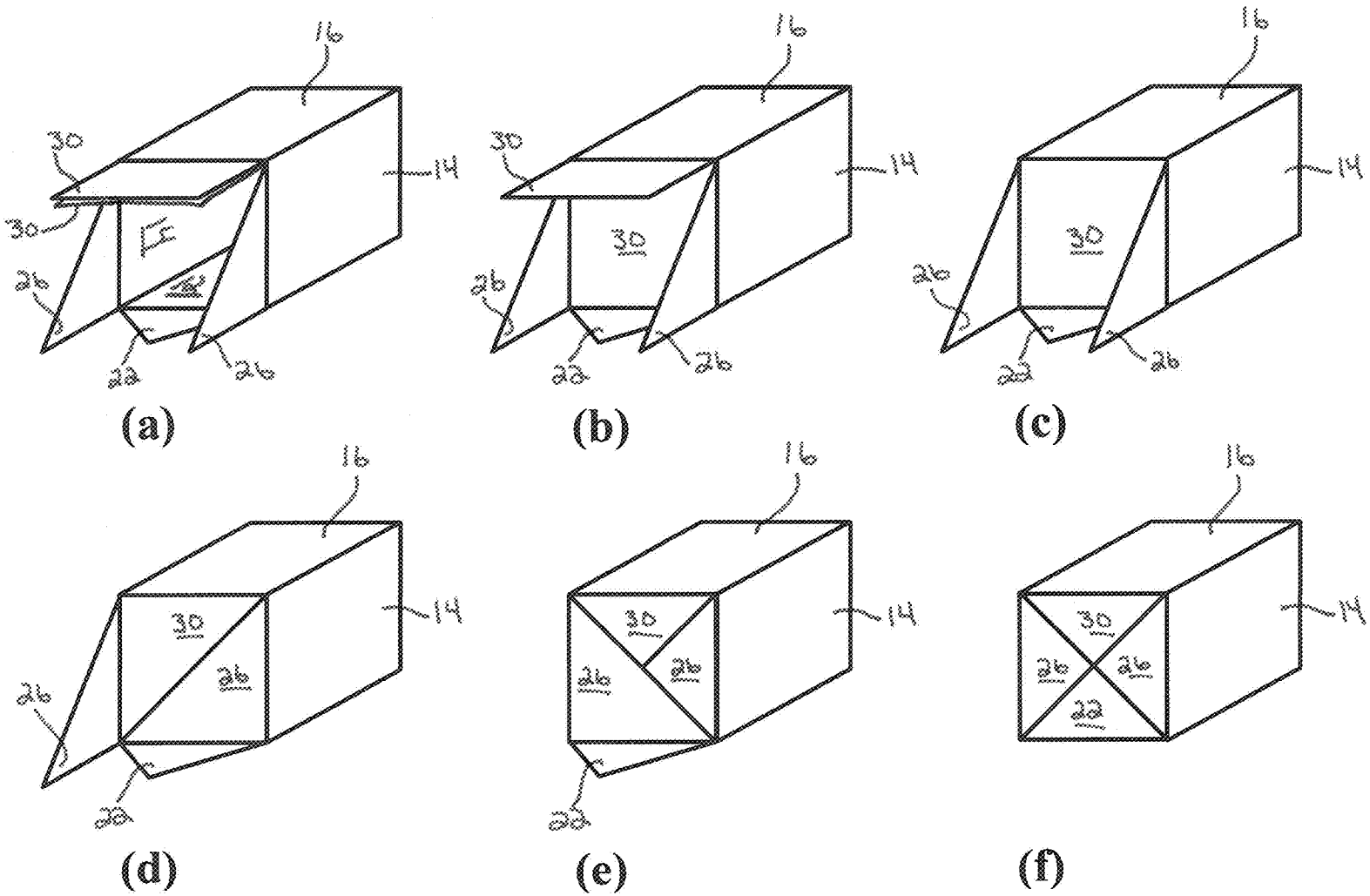
FIGS. 4(*a*)-(*f*) are perspective views of the packaging sheet of FIGS. 2 and 3 in first, second, third, fourth, fifth, and sixth stages of construction, respectively, to wrap the article or object, provide structure around the article or object, or form the box, of FIG. 1(*a*), according to an exemplary embodiment.

In an exemplary embodiment, as illustrated in FIGS. 2-4, a packaging sheet made to fit (or form) the article, object, or box shown in FIG. 1(*a*) is generally referred to by the reference numeral 10. Although the packaging sheet 10 is described herein with reference to the article, object, or box shown in FIG. 1(*a*), the dimensions of the packaging sheet 10 can be altered to fit any size article, object, or box where the width w is approximately equal to the height h (i.e., w≈h). Referring to FIG. 2, the packaging sheet 10 includes a plurality of rectangular panels connected in series with one another. In particular, a pair of opposing side panels 14 are connected to a centrally located bottom panel 12 and a pair of top panels 16 are connected to the respective side panels 14, opposite the bottom panel 12. The bottom panel 12 and the top panels 16 are substantially identical, each defining the length l and the width w. Moreover, the side panels 14 are substantially identical, each defining the length l and the height h. The side panels 14 are connected to the bottom panel 12 along respective edges 18 thereof that define the length l. Similarly, the top panels 16 are connected to the side panels 14 along respective edges 20 thereof that define the length l. Thus, the length l is a shared dimension between the bottom panel 12, the side panels 14, and the top panels 16.

A pair of bottom flaps 22 are connected to the bottom panel 12, each including a pair of outer edges extending at angles α with respect to the adjoining edge of the bottom panel 12. In the embodiment of FIG. 2, the angles α are about 45 degrees and the bottom flaps 22 each define a triangular shape. In several exemplary embodiments, the angles α are between 40 degrees and 50 degrees. In several exemplary embodiments, the angles α are acute. The bottom flaps 22 are connected to the bottom panel 12 along respective edges 24 thereof that define the width w, which width is shared between the bottom flaps 22 and the bottom panel 12. In addition to the width w, the bottom flaps 22 each extend a distance x from the edge 24 to a distal portion thereof, the distance x being the lesser of: one-half the width w; and the height h. Further, a pair of side flaps 26 are connected to each of the side panels 14, each including a long edge extending at an angle β with respect to the adjoining edge of the side panel 14, and a short edge extending at a 90-degree angle with respect to the adjoining edge of the side panel 14. In the embodiment of FIG. 2, the angles 3 are about 45 degrees and the side flaps 26 are triangular in shape. In several exemplary embodiments, the angles β are between 40 degrees and 50 degrees. In several exemplary embodiments, the angles β are acute. The side flaps 26 are connected to the respective side panels 14 along respective edges 28 thereof that define the height h, which height is shared between the side flaps 26 and the side panels 14. In addition to the height h, the side flaps 26 each extend a distance approximately equal to the height h from the edge 28 to a distal portion thereof. Finally, a pair of top flaps 30 are connected to each of the top panels 16 along respective edges 32 thereof that define the width w, which width is shared between the top flaps 30 and the top panels 16. In addition to the width w, the top flaps 30 each extend a distance approximately equal to the height h from the edge 32 to a distal portion thereof. In the embodiment of FIG. 2, the top flaps 30 are rectangular in shape. In several exemplary embodiments, so long as the panels 12 and 16 are sized according to the length l and the width w, the panels 14 are sized according to the length l and the height h, and the angles α and β are each about 45 degrees, the packaging sheet 10 can be made to fit any size article, object, or box where the width w is approximately equal to the height h (i.e., w≈h).

In several exemplary embodiments, the side flaps 26 of the packaging sheet 10 are cut along respective lines A-A (shown in FIG. 2) so that the respective distal end portions of the resulting side flaps each define straight-cut lines (rather than points) and extend the distance x (rather than the height h) from the respective edges 28. As a result, the side flaps are trapezoidal in shape (shown pre-cut in FIG. 9). In several exemplary embodiments, the top flaps 30 of the packaging sheet 10 are cut along the respective lines A-A so that the respective distal end portions of the resulting top flaps each define straight-cut lines, and extend the distance x (rather than the height h) from the respective edges 32. As a result, the top flaps are rectangular in shape (shown pre-cut in FIG. 9). In several exemplary embodiments, the side flaps 26 and the top flaps 30 of the packaging sheet 10 are cut along the respective lines A-A so that the respective distal end portions of the resulting side flaps and top flaps each define straight-cut lines and extend the distance x (rather than the height h) from the respective edges 28 and 32. As a result, the side flaps are trapezoidal in shape, and the top flaps are rectangular in shape (shown pre-cut in FIG. 9).

As shown in FIG. 3, the packaging sheet 10 may initially be in the form of a pre-cut (such as die-cut) two-dimensional sheet comprising a base layer 34 and a laminate layer 36 that is thermally adhered (or cold-pressed) to one side of the packaging sheet 10. The base layer 34 may be or include gift wrap, butcher paper, card stock, plastic, another fibrous or polymeric sheet material, or any combination thereof. In an exemplary embodiment, the laminate layer 36 defines a thickness of about 0.002-inches. In several exemplary embodiments, the laminate layer 36 defines a thickness ranging from about 0.001 inches to about 0.010 inches. In several exemplary embodiments, the packaging sheet 10 includes the laminate layer 36 thermally adhered (or cold-pressed) to one side of the packaging sheet 10, and another laminate layer (not shown) thermally adhered (or cold-pressed) to the other side of the packaging sheet 10. In an exemplary embodiment, the laminate layer 36 and the another laminate layer each define a thickness of about 0.002-inches. In several exemplary embodiments, the laminate layer 36 and the another laminate layer each define a thickness ranging from about 0.001 inches to about 0.010 inches. In several exemplary embodiments, one of the laminate layer 36 and the another laminate layer defines a thickness of about 0.002-inches, and the other of the laminate layer 36 and the another laminate layer defines a thickness ranging from about 0.001 inches to about 0.010 inches. The laminate layer 36 (and the another laminate layer) provides sufficient structural integrity to the base layer 34 so that the packaging sheet 10 can be reused. Thus, after the packaging sheet 10 has been used to package a gift and the gift has been unwrapped or taken out of the box, the packaging sheet 10 can be reused to package another gift. In those embodiments where only one side of the packaging sheet 10 is laminated, the laminate layer 36 is applied to the top of the decorative, or exterior, side of the base layer 34.

In operation, in an exemplary embodiment, as illustrated in FIGS. 4(*a*)-(*f*), the packaging sheet 10 of FIGS. 2 and 3 is used to wrap the article or object, provide structure around the article or object, or form the box, of FIG. 1(*a*). In particular, the side panels 14 of the packaging sheet 10 are folded along the edges 18 at right-angles relative to the bottom panel 12. In a similar manner, the top panels 16 of the packaging sheet 10 are folded along the edges 20 at right-angles relative to the respective side panels 14. As a result, the top panels 16 overlap, align, and can be detachably connected to one another, so that the packaging sheet 10 forms a generally tubular shape defining opposing end portions. The packaging sheet 10 is illustrated in FIG. 4(*a*) forming the generally tubular shape with one of the opposing end portions thereof being enclosed by the corresponding top flaps 30, side flaps 26, and bottom flap 22. FIGS. 4(*b*) and (*c*) illustrate the other end portion of the tubular shape formed by the packaging sheet 10 being enclosed by first folding the top flaps 30 along the edges 32 at right-angles relative to the respective top panels 16. Next, as shown in FIGS. 4(*d*) and (*e*), the side flaps 26 are folded along the edges 28 at right-angles relative to the side panels 14, and are overlapped with the top flaps 30 and one another. Finally, as shown in FIG. 4(*f*), the bottom flap 22 is folded along the edge 24 at a right-angle relative to the bottom panel 12, and is overlapped and detachably connected to one or more of the side flaps 26 and the top flaps 30.

In several exemplary embodiments, the packaging sheet 10 may be used to wrap another article or object having length, width, and height dimensions that are equal to, or less than, the length l, the width w, and the height h.

Figure 5:
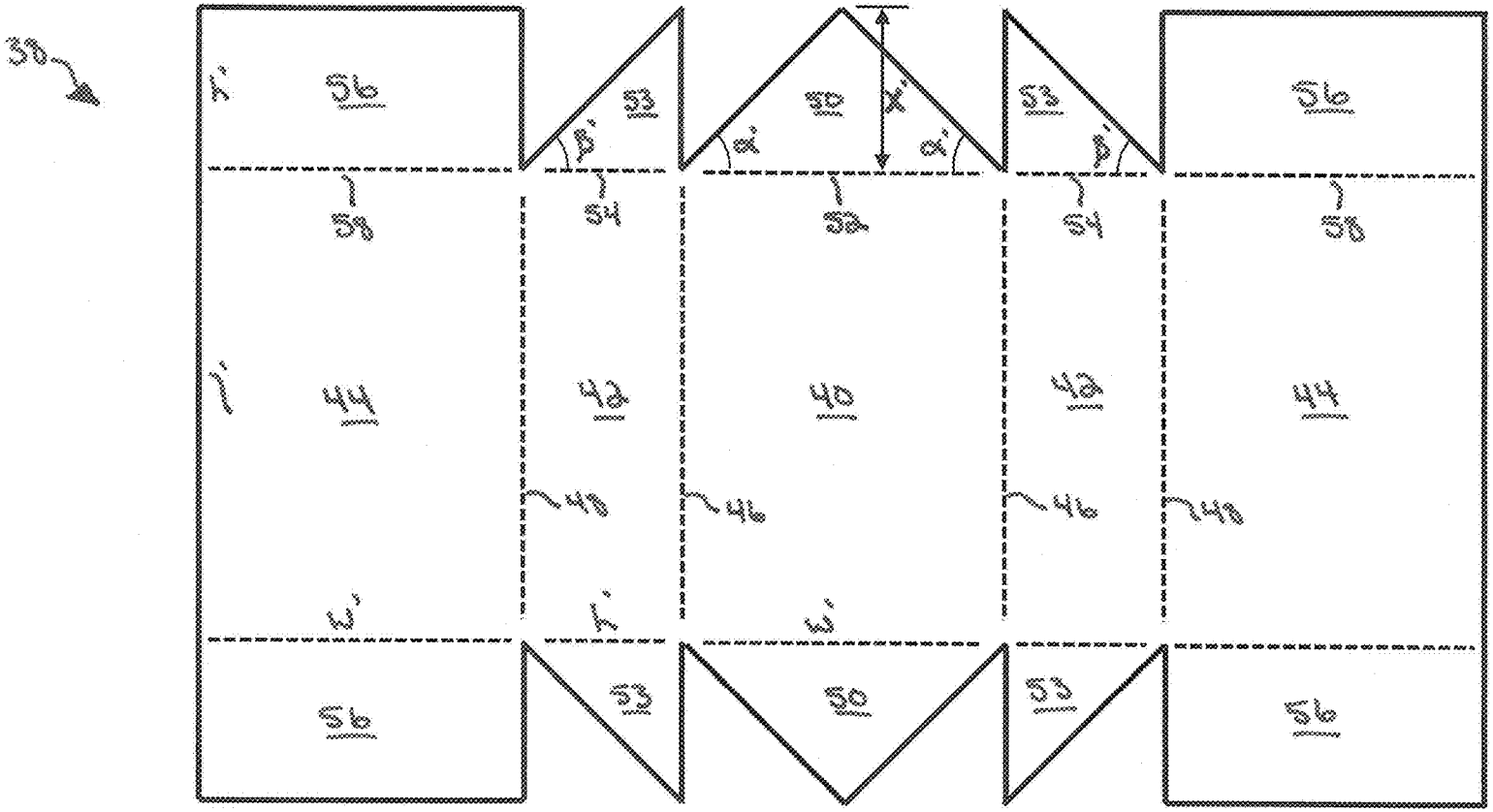
FIG. 5 is a plan view of a packaging sheet adapted to wrap the article or object, provide structure around the article or object, or form the box, of FIG. 1(*b*), according to an exemplary embodiment.

In an exemplary embodiment, as illustrated in FIG. 5, a packaging sheet made to fit (or form) the article, object, or box shown in FIG. 1(*b*) is generally referred to by the reference numeral 38. Although the packaging sheet 38 is described herein with reference to the article, object, or box shown in FIG. 1(*b*), the dimensions of the packaging sheet 38 can be altered to fit any size article, object, or box where the width w' is approximately two-times the height h' (i.e., $w' \approx 2\ h'$). Moreover, the dimensions of the packaging sheet 38 can be altered to fit any size article, object, or box where the width w' is greater than the height h' and less than (or equal to) two-times the height h' (i.e., $h' < w' \leq 2\ h'$)—the packaging sheet may end up looking different than the packaging sheet 38, but the methodology to make the systematic or mathematical pattern is the same. Referring to FIG. 5, the packaging sheet 38 includes a plurality of rectangular panels connected in series with one another. In particular, a pair of opposing side panels 42 are connected to a centrally located bottom panel 40, and a pair of top panels 44 are connected to the respective side panels 42, opposite the bottom panel 40. The bottom panel 40 and the top panels 44 are substantially identical, each defining the length l' and the width w'. Moreover, the side panels 42 are substantially identical, each defining the length l' and the height h'. The side panels 42 are connected to the bottom panel 40 along respective edges 46 thereof that define the length l'. Similarly, the top panels 44 are connected to the side panels 42 along respective edges 48 thereof that define the length l'. Thus, the length l' is a shared dimension between the bottom panel 40, the side panels 42, and the top panels 44.

A pair of bottom flaps 50 are connected to the bottom panel 40, each including a pair of outer edges extending at angles α' with respect to the adjoining edge of the bottom panel 40. In the embodiment of FIG. 5, the angles α' are about 45 degrees and the bottom flaps 50 are triangular in shape. In several exemplary embodiments, the angles α' are between 40 degrees and 50 degrees. In several exemplary embodiments, the angles α' are acute. The bottom flaps 50 are connected to the bottom panel 40 along respective edges 52 thereof that define the width w', which width is shared between the bottom flaps 50 and the bottom panel 40. In addition to the width w', the bottom flaps 50 each extend a distance x' from the edge 52 to a distal portion thereof, the distance x' being the lesser of: one-half the width w'; and the height h'. In those embodiments where the width w' is approximately two-times the height h' (i.e., $w'=2\ h'$), the distance x' is approximately equal to the height h' (i.e., $x' \approx h'$). Further, a pair of side flaps 53 are connected to each of the side panels 42, each including a long edge extending at an angle β' with respect to the adjoining edge of the side panel 42, and a short edge extending at a 90-degree angle with respect to the adjoining edge of the side panel 42. In the embodiment of FIG. 5, the angles 1' are about 45 degrees and the side flaps 53 are triangular in shape. In several exemplary embodiments, the angles β' are between 40 degrees and 50 degrees. In several exemplary embodiments, the angles β' are acute. The side flaps 53 are connected to the respective side panels 42 along respective edges 54 thereof that define the height h', which height is shared between the side flaps 53 and the side panels 42. In addition, the side flaps 53 each extend a distance approximately equal to the height h' (and the distance x') from the edge 54 to a distal portion thereof. Finally, a pair of top flaps 56 are connected to each of the top panels 44 along respective edges 58 thereof that define the width w', which width is shared between the top flaps 56 and the top panels 44. In addition to the width w', the top flaps 56 each extend a distance approximately equal to the height h' from the edge 58 to a distal portion thereof. In the embodiment of FIG. 5, the top flaps 56 are rectangular in shape. In several exemplary embodiments, so long as the panels 40 and 44 are sized according to the length l' and the width w', the panels 42 are sized according to the length l' and the height h', and the angles α' and β' are each about 45 degrees, the packaging sheet 38 can be made to fit any size article, object, or box where the width w' is greater than the height h' and less than two-times the height h' (i.e., $h' < w' < 2\ h'$).

In several exemplary embodiments, to reduce tearing and/or crumpling, the packaging sheet 38 is laminated in a manner similar to the manner in which the packaging sheet 10 is laminated. Therefore, the lamination of the packaging sheet 38 will not be discussed in further detail. As a result, after the packaging sheet 38 has been used to package a gift and the gift has been unwrapped or taken out of the box, the packaging sheet 38 can be reused to package another gift.

In operation, in an exemplary embodiment, the packaging sheet 38 is used to wrap an article or object, provide structure around the article or object, or form a box, defining the length l', the width w', and the height h' in a manner similar to the manner in which the packaging sheet 10 is used to wrap the article or object, provide structure around the article or object, or form the box, defining the length l, the width w, and the height h. Therefore, the operation of the packaging sheet 38 will not be discussed in further detail.

In several exemplary embodiments, the packaging sheet 38 may be used to wrap another article or object having length, width, and height dimensions that are equal to, or less than, the length l', the width w', and the height h'.

Figure 6:
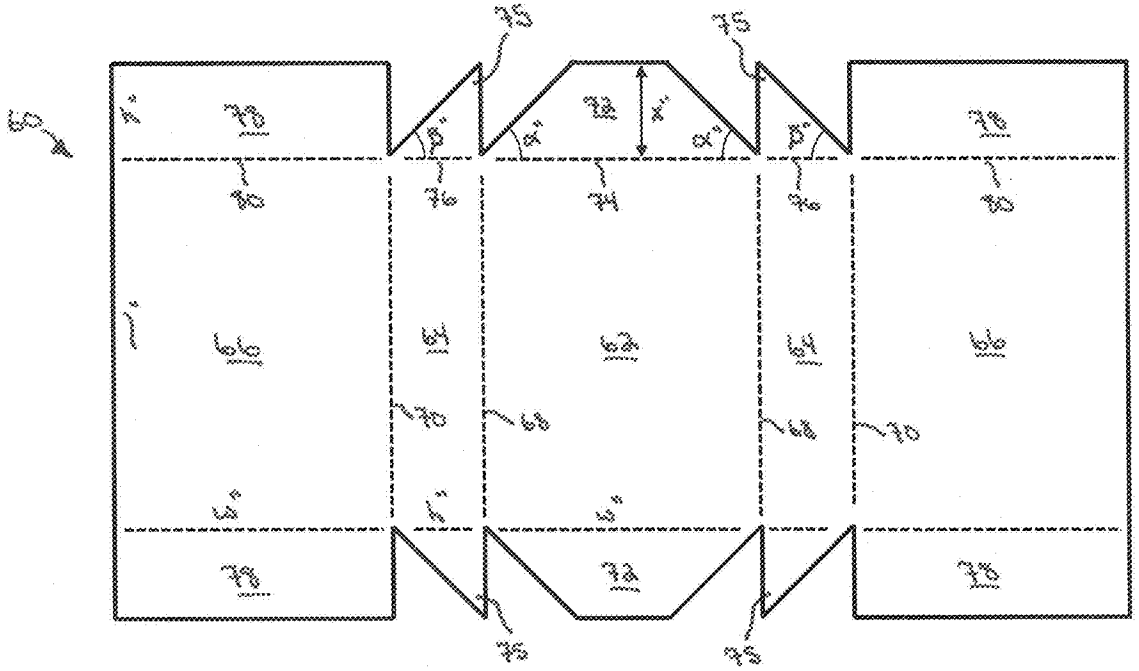
FIG. 6 is a plan view of a packaging sheet adapted to wrap the article or object, provide structure around the article or object, or form the box, of FIG. 1(*c*), according to an exemplary embodiment.

In an exemplary embodiment, as illustrated in FIG. 6, a packaging sheet made to fit (or form) the article, object, or box shown in FIG. 1(*c*) is generally referred to by the reference numeral 60. Although the packaging sheet 60 is described herein with reference to the article, object, or box shown in FIG. 1(*c*), the dimensions of the packaging sheet 60 can be altered to fit any size article, object, or box where the width w" is approximately three-times the height h" (i.e., w"≈3 h"). Moreover, the dimensions of the packaging sheet 60 can be altered to fit any size article, object, or box where the width w" is greater than two-times the height h" (i.e., w">2 h")—the packaging sheet may end up looking different than the packaging sheet 60, but the methodology to make the systematic or mathematical pattern is the same. Referring to FIG. 6, the packaging sheet 60 includes a plurality of rectangular panels connected in series with one another. In particular, a pair of opposing side panels 64 are connected to a centrally located bottom panel 62, and a pair of top panels 66 are connected to the respective side panels 64, opposite the bottom panel 62. The bottom panel 62 and the top panels 66 are substantially identical, each defining the length l" and the width w".

Moreover, the side panels 64 are substantially identical, each defining the length l" and the height h". The side panels 64 are connected to the bottom panel 62 along respective edges 68 thereof that define the length l". Similarly, the top panels 66 are connected to the side panels 64 along respective edges 70 thereof that define the length l". Thus, the length l" is a shared dimension between the bottom panel 62, the side panels 64, and the top panels 66.

A pair of bottom flaps 72 are connected to the bottom panel 62, each including a pair of outer edges extending at angles α" with respect to the adjoining edge of the bottom panel 62. In the embodiment of FIG. 6, the angles α" are about 45 degrees and the bottom flaps 72 are trapezoidal in shape. In several exemplary embodiments, the angles α" are between 40 degrees and 50 degrees. In several exemplary embodiments, the angles α" are acute. The bottom flaps 72 are connected to the bottom panel 62 along respective edges 74 thereof that define the width w", which width is shared between the bottom flaps 72 and the bottom panel 62. In addition to the width w", the bottom flaps 72 each extend a distance x" from the edge 74 to a distal portion thereof, the distance x" being the lesser of: one-half the width w"; and the height h". In those embodiments where the width w" is approximately three-times the height h" (i.e., w"≈3 h"), the distance x" is approximately equal to the height h" (i.e., x"≈h"). Additionally, since the width w" is greater than two-times the height h" (i.e., w">2 h"), the respective distal end portions of the bottom flaps 72 define straight-cut lines, rather than points. Further, a pair of side flaps 75 are connected to each of the side panels 64, each including a long edge extending at an angle β" with respect to the adjoining edge of the side panel 64, and a short edge extending at a 90-degree angle with respect to the adjoining edge of the side panel 64. In the embodiment of FIG. 6, the angles β" are about 45 degrees and the side flaps 75 are triangular in shape. In several exemplary embodiments, the angles β" are between 40 degrees and 50 degrees. In several exemplary embodiments, the angles β" are acute. The side flaps 75 are connected to the respective side panels 64 along respective edges 76 thereof that define the height h", which height is shared between the side flaps 75 and the side panels 64. In addition, the side flaps 75 each extend a distance approximately equal to the height h" (and the distance x") from the edge 76 to a distal portion thereof. Finally, a pair of rectangular top flaps 78 are connected to each of the top panels 66 along respective edges 80 thereof that define the width w", which width is shared between the top flaps 78 and the top panels 66. In addition to the width w", the top flaps 78 each extend a distance approximately equal to the height h" from the edge 80 to a distal portion thereof. In the embodiment of FIG. 6, the top flaps 78 are rectangular in shape. In several exemplary embodiments, so long as the panels 62 and 66 are sized according to the length l" and the width w", the panels 64 are sized according to the length l" and the height h", and the angles α" and β" are each about 45 degrees, the packaging sheet 60 can be made to fit any size article, object, or box where the width w" is greater than two-times the height h" (i.e., w">2 h").

In several exemplary embodiments, to reduce tearing and/or crumpling, the packaging sheet 60 is laminated in a manner similar to the manner in which the packaging sheet 10 is laminated. Therefore, the lamination of the packaging sheet 60 will not be discussed in further detail. As a result, after the packaging sheet 60 has been used to package a gift and the gift has been unwrapped or taken out of the box, the packaging sheet 60 can be reused to package another gift.

In operation, in an exemplary embodiment, the packaging sheet 60 is used to wrap an article or object, provide structure around the article or object, or form a box, defining the length l", the width w", and the height h" in a manner similar to the manner in which the packaging sheet 10 is used to wrap the article or object, provide structure around the article or object, or form the box, defining the length l, the width w, and the height h. Therefore, the operation of the packaging sheet 60 will not be discussed in further detail.

In several exemplary embodiments, the packaging sheet 60 may be used to wrap another article or object having length, width, and height dimensions that are equal to, or less than, the length l", the width w", and the height h".

Figure 7:
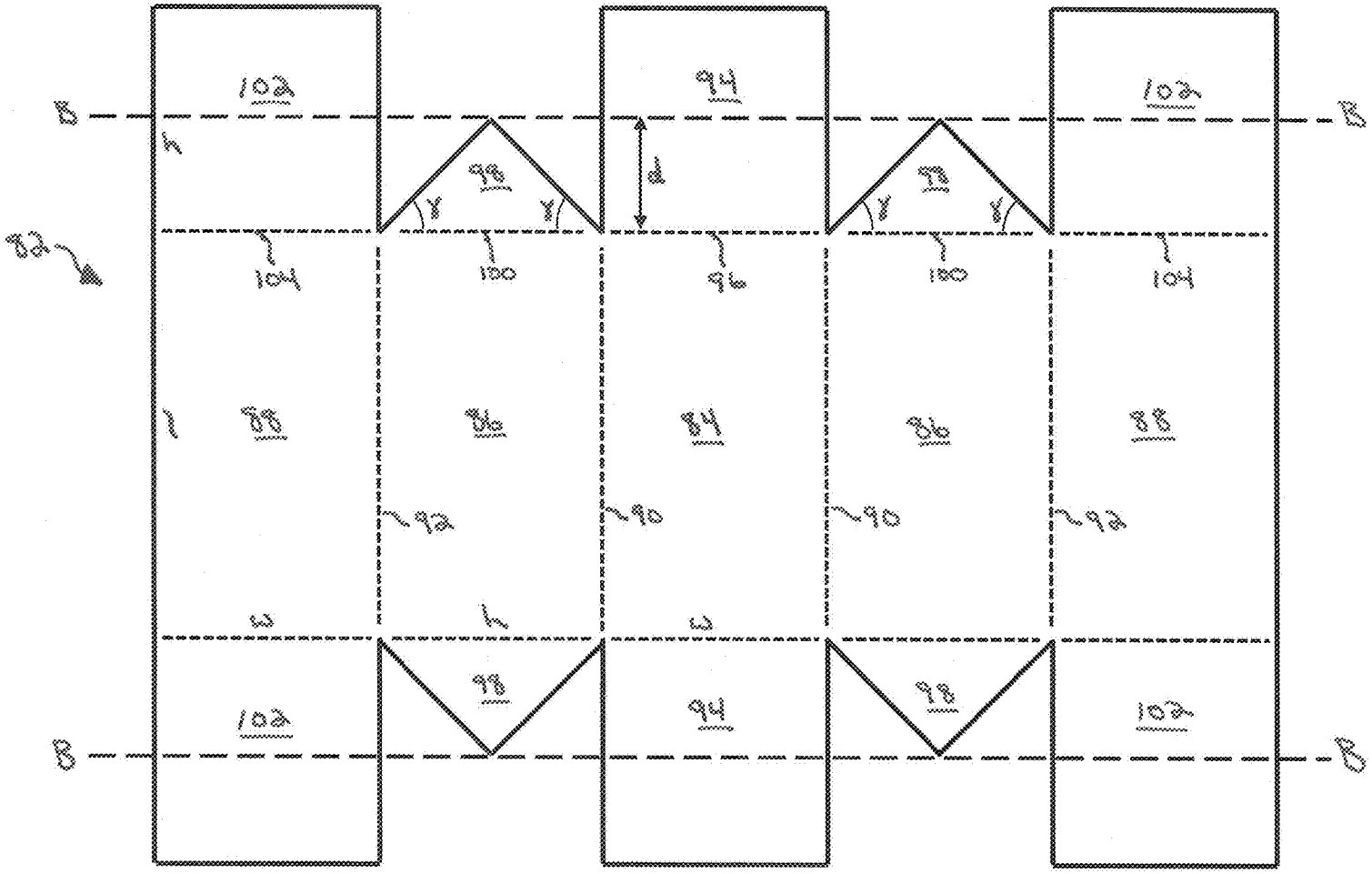
FIG. 7 is a plan view of another packaging sheet adapted to wrap the article or object, provide structure around the article or object, or form the box, of FIG. 1(*a*), according to an exemplary embodiment.

In an exemplary embodiment, as illustrated in FIG. 7, another packaging sheet made to fit (or form) the article, object, or box shown in FIG. 1(*a*) is generally referred to by the reference numeral 82. Although the packaging sheet 82 is described herein with reference to the article, object, or box shown in FIG. 1(*a*), the dimensions of the packaging sheet 82 can be altered to fit any size article, object, or box where the width w is approximately equal to the height h (i.e., w≈h). Referring to FIG. 7, the packaging sheet 82 includes a plurality of rectangular panels connected in series with one another. In particular, a pair of opposing side panels 86 are connected to a centrally located bottom panel 84, and a pair of top panels 88 are connected to the respective side panels 86, opposite the bottom panel 84. The bottom panel 84 and the top panels 88 are substantially identical, each defining the length l and the width w. Moreover, the side panels 86 are substantially identical, each defining the length l and the height h. The side panels 86 are connected to the bottom panel 84 along respective edges 90 thereof that define the length l. Similarly, the top panels 88 are connected to the side panels 86 along respective edges 92 thereof that define the length l. Thus, the length l is a shared dimension between the bottom panel 84, the side panels 86, and the top panels 88.

A pair of bottom flaps 94 are connected to the bottom panel 84 along respective edges 96 thereof that define the width w, which width is shared between the bottom flaps 94 and the bottom panel 84. In addition to the width w, the bottom flaps 94 each extend a distance approximately equal to the height h from the edge 96 to a distal portion thereof. In the embodiment of FIG. 7, the bottom flaps 94 are rectangular in shape. Further, a pair of side flaps 98 are connected to each of the side panels 86, each including a pair of outer edges extending at angles γ with respect to the adjoining edge of the side panels 86. In the embodiment of FIG. 7, the angles γ are about 45 degrees and the side flaps 98 are triangular in shape. In several exemplary embodiments, the angles γ are between 40 degrees and 50 degrees. In several exemplary embodiments, the angles γ are acute. The side flaps 98 are connected to the side panels 86 along respective edges 100 thereof that define the height h, which height is shared between the side flaps 98 and the side panels 86. In addition to the height h, the side flaps 98 each extend a distance d from the edge 100 to a distal portion thereof, the distance d being approximately one-half the height h (i.e., d≈½ h). Finally, a pair of top flaps 102 are connected to the top panels 88 along respective edges 104 thereof that define the width w, which width is shared between the top flaps 102 and the top panels 88. In addition to the width w, the top flaps 102 each extend a distance approximately equal to the height h from the edge 104 to a distal portion thereof. In the embodiment of FIG. 7, the top flaps 102 are rectangular in shape. In several exemplary embodiments, so long as the panels 84 and 88 are sized according to the length l and the width w, the panels 86 are sized according to the length l and the height h, and the angles γ are each about 45 degrees, the packaging sheet 82 can be made to fit any size article, object, or box where the width w is approximately equal to the height h (i.e., w≈h).

In several exemplary embodiments, the bottom flaps 94 of the packaging sheet 82 are cut along respective lines B-B (shown in FIG. 7) so that the respective distal end portions of the resulting bottom flaps each define straight-cut lines and extend the distance d (rather than the height h) from the respective edges 96. In several exemplary embodiments, the top flaps 102 of the packaging sheet 82 are cut along the respective lines B-B so that the respective distal end portions of the resulting top flaps each define straight-cut lines, and extend the distance d (rather than the height h) from the respective edges 104. In several exemplary embodiments, the bottom flaps 94 and the top flaps 102 of the packaging sheet 82 are cut along the respective lines B-B so that the respective distal end portions of the resulting bottom flaps and top flaps each define straight-cut lines and extend the distance d (rather than the height h) from the respective edges 96 and 104.

In several exemplary embodiments, to reduce tearing and/or crumpling, the packaging sheet 82 is laminated in a manner similar to the manner in which the packaging sheet 10 is laminated. Therefore, the lamination of the packaging sheet 82 will not be discussed in further detail. As a result, after the packaging sheet 82 has been used to package a gift and the gift has been unwrapped or taken out of the box, the packaging sheet 82 can be reused to package another gift.

In operation, in an exemplary embodiment, the packaging sheet 82 of FIG. 7 is used to wrap the article or object, provide structure around the article or object, or form the box, of FIG. 1(*a*). In particular, the side panels 86 of the packaging sheet 82 are folded along the edges 90 at right-angles relative to the bottom panel 84. In a similar manner, the top panels 88 of the packaging sheet 82 are folded along the edges 92 at right-angles relative to the respective side panels 86. As a result, the top panels 88 overlap, align, and can be detachably connected to one another, so that the packaging sheet 82 forms a generally tubular shape defining opposing end portions. The opposing end portions of the tubular shape formed by the packaging sheet 82 are enclosed by first folding the top flaps 102 along the edges 104 at right-angles relative to the respective top panels 88. Next, the bottom flaps 94 are folded along the edges 96 at right-angles relative to the bottom panel 84. Finally, the side flaps 98 are folded along the edges 100 at right-angles relative to the side panels 86, and are overlapped and detachably connected to one or more of the bottom flaps 94 and the top flaps 102.

In several exemplary embodiments, the packaging sheet 82 may be used to wrap another article or object having length, width, and height dimensions that are equal to, or less than, the length l, the width w, and the height h.

Figure 8:
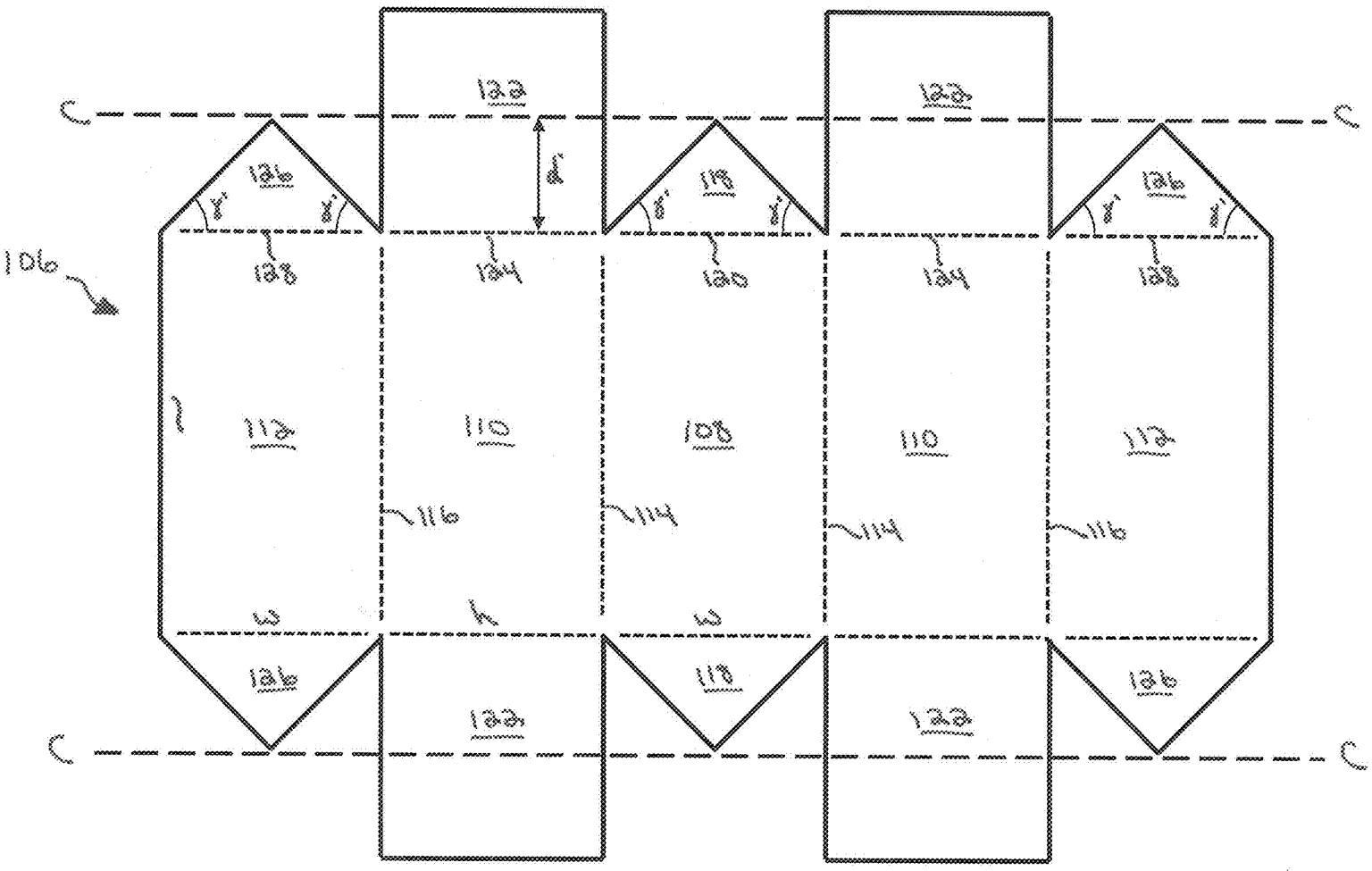
FIG. 8 is a plan view of yet another packaging sheet adapted to wrap the article or object, provide structure around the article or object, or form the box, of FIG. 1(*a*), according to an exemplary embodiment.

In an exemplary embodiment, as illustrated in FIG. 8, yet another packaging sheet made to fit (or form) the article, object, or box shown in FIG. 1(*a*) is generally referred to by the reference numeral 106. Although the packaging sheet 106 is described herein with reference to the article, object, or box shown in FIG. 1(*a*), the dimensions of the packaging sheet 106 can be altered to fit any size article, object, or box where the width w is approximately equal to the height h (i.e., w≈h). Referring to FIG. 8, the packaging sheet 106 includes a plurality of rectangular panels connected in series with one another. In particular, a pair of opposing side panels 110 are connected to a centrally located bottom panel 108, and a pair of top panels 112 are connected to the respective side panels 110, opposite the bottom panel 108. The bottom panel 108 and the top panels 112 are substantially identical, each defining the length l and the width w. Moreover, the side panels 110 are substantially identical, each defining the length l and the height h. The side panels 110 are connected to the bottom panel 108 along respective edges 114 thereof that define the length l. Similarly, the top panels 112 are connected to the side panels 110 along respective edges 116 thereof that define the length l. Thus, the length l is a shared dimension between the bottom panel 108, the side panels 110, and the top panels 112.

A pair of bottom flaps 118 are connected to the bottom panel 108, each including a pair of outer edges extending at angles γ' with respect to the adjoining edge of the bottom panel 108. In the embodiment of FIG. 8, the angles γ' are about 45 degrees and the bottom flaps 118 are triangular in shape. In several exemplary embodiments, the angles γ' are between 40 degrees and 50 degrees. In several exemplary embodiments, the angles γ' are acute. The bottom flaps 118 are connected to the bottom panel 108 along respective edges 120 thereof that define the width w, which width w is shared between the bottom flaps 118 and the bottom panel 108. In addition to the width w, the bottom flaps 118 each extend a distance d' from the edge 120 to a distal portion thereof, the distance d' being approximately one-half the width w (i.e., d'≈½ w). Further, a pair of side flaps 122 are connected to the each of the side panels 110 along respective edges 124 thereof that define the height h, which height is shared between the side flaps 122 and the side panels 110. In addition to the height h, the side flaps 122 each extend a distance approximately equal to the height h from the edge 124 to a distal portion thereof. In the embodiment of FIG. 8, the side flaps 122 are rectangular in shape. Finally, a pair of top flaps 126 are connected to each of the top panels 112, each including a pair of outer edges extending at the angles γ' with respect to the adjoining edge of the top panels 112. In the embodiment of FIG. 8, the top flaps 122 are triangular in shape. In several exemplary embodiments, the angles γ' are between 40 degrees and 50 degrees. The top flaps 126 are connected to the top panels 112 along respective edges 128 thereof that define the width w, which width w is shared between the top flaps 126 and the top panels 112. In addition to the width w, the top flaps 126 each extend the distance d' from the edge 128 to a distal portion thereof, the distance d' being approximately one-half the width w (i.e., d'≈½ w). In several exemplary embodiments, so long as the panels 108 and 112 are sized according to the length l and the width w, the panels 110 are sized according to the length l and the height h, and the angles γ' are each about 45 degrees, the packaging sheet 106 can be made to fit any size article, object, or box where the width w is approximately equal to the height h (i.e., w≈h).

In several exemplary embodiments, the side flaps 122 of the packaging sheet 106 are cut along respective lines C-C (shown in FIG. 8) so that the respective distal end portions of the resulting side flaps each define straight-cut lines and extend the distance d' (rather than the height h) from the respective edges 120.

In several exemplary embodiments, to reduce tearing and/or crumpling, the packaging sheet 106 is laminated in a manner similar to the manner in which the packaging sheet 10 is laminated. Therefore, the lamination of the packaging sheet 106 will not be discussed in further detail. As a result, after the packaging sheet 106 has been used to package a gift and the gift has been unwrapped or taken out of the box, the packaging sheet 106 can be reused to package another gift.

In operation, in an exemplary embodiment, the packaging sheet 106 of FIG. 8 is used to wrap the article or object, provide structure around the article or object, or form the box, of FIG. 1(*a*). In particular, the side panels 110 of the packaging sheet 106 are folded along the edges 114 at right-angles relative to the bottom panel 108. In a similar manner, the top panels 112 of the packaging sheet 106 are folded along the edges 116 at right-angles relative to the respective side panels 110. As a result, the top panels 112 overlap, align, and can be detachably connected to one another, so that the packaging sheet 106 forms a generally tubular shape defining opposing end portions. The opposing end portions of the tubular shape formed by the packaging sheet 106 are enclosed by first folding the side flaps 122 along the edges 124 at right-angles relative to the respective side panels 110. Next, the top flaps 126 are folded along the edges 128 at right-angles relative to the respective top panels 112. Finally, the bottom flaps 118 are folded along the edges 120 at right-angles relative to the bottom panel 108, and are overlapped and detachably connected to one or more of the side flaps 122 and the top flaps 126.

In several exemplary embodiments, the packaging sheet 106 may be used to wrap another article or object having length, width, and height dimensions that are equal to, or less than, the length l, the width w, and the height h.

Figure 9:
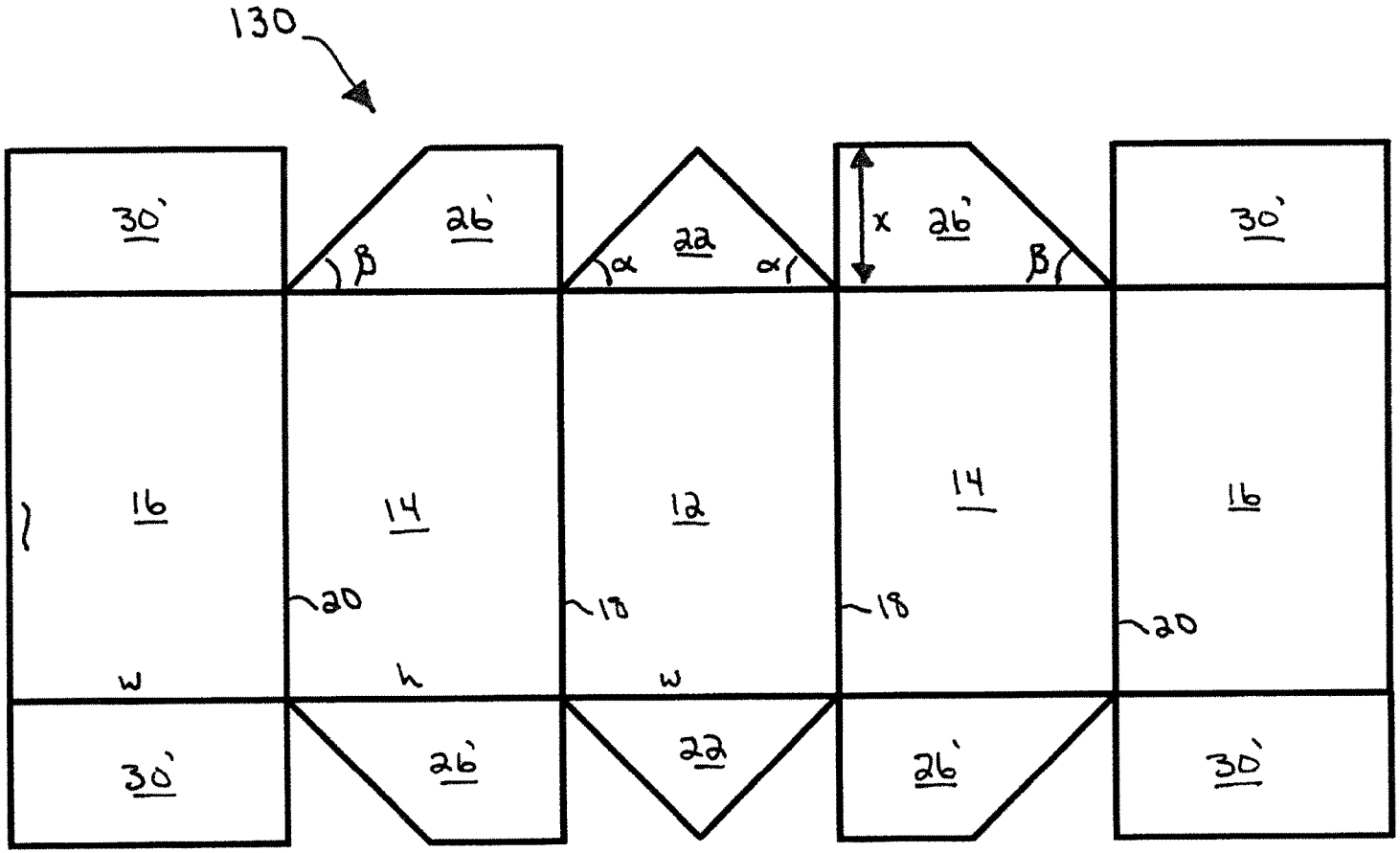
FIG. 9 is a plan view of a packaging sheet adapted to wrap the article or object, provide structure around the article or object, or form the box, of FIG. 1(*a*), according to an exemplary embodiment.

In an exemplary embodiment, as illustrated in FIG. 9, a packaging sheet made to fit (or form) the article, object, or box shown in FIG. 1(*a*) is generally referred to by the reference numeral 130. Although the packaging sheet 130 is described herein with reference to the article, object, or box shown in FIG. 1(*a*), the dimensions of the packaging sheet 130 can be altered to fit any size article, object, or box where the width w is approximately equal to the height h (i.e., w≈h). The packaging sheet 130 includes several features that are substantially identical to corresponding features of the packaging sheet 10, which identical features are given the same reference numerals. In some embodiments of the packaging sheet 130, the side flaps 26 are replaced with pre-cut side flaps 26' whose respective distal end portions each define straight-cut lines (rather than points) and extend the distance x (rather than the height h) from the respective edges 28. As a result, the side flaps 26' are trapezoidal in shape. In some embodiments of the packaging sheet 130, the top flaps 30 are replaced with pre-cut top flaps 30' whose respective distal end portions each define straight-cut lines and extend the distance x (rather than the height h) from the respective edges 32. As a result, the top flaps 30' are rectangular in shape. In some embodiments of the packaging sheet 130 (one of which is shown in FIG. 9), the side flaps 26 are replaced with pre-cut side flaps 26' whose respective distal end portions each define straight-cut lines (rather than points) and extend the distance x (rather than the height h) from the respective edges 28, and the top flaps 30 are replaced with pre-cut top flaps 30' whose respective distal end portions each define straight-cut lines and extend the distance x (rather than the height h) from the respective edges 32. As a result, the side flaps 26' are trapezoidal in shape and the top flaps 30' are rectangular in shape.

The present disclosure introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively; wherein the second and third flaps each define either a first triangular shape or a first trapezoidal shape. In an exemplary embodiment, the first flap defines either a second triangular shape or a second trapezoidal shape. In an exemplary embodiment, the fourth and fifth flaps each define a rectangular shape. In an exemplary embodiment, the second and third flaps each define the first triangular shape and the first flap defines the second triangular shape. In an exemplary embodiment, the second and third flaps each define the first trapezoidal shape and the first flap defines the second triangular shape. In an exemplary embodiment, the second and third flaps each define the first triangular shape and the first flap defines the second trapezoidal shape. In an exemplary embodiment, the first flap defines a first rectangular shape and the fourth and fifth flaps each define a second rectangular shape. In an exemplary embodiment, the packaging sheet further includes sixth, seventh, eighth, ninth, and tenth flaps connected to the first, second, third, fourth, and fifth panels, respectively, opposite the first, second, third, fourth, and fifth flaps, respectively; wherein the seventh and eighth flaps each define either the first triangular shape or the first trapezoidal shape. In an exemplary embodiment, the first and sixth flaps each define either a second triangular shape or a second trapezoidal shape. In an exemplary embodiment, the fourth, fifth, ninth, and tenth flaps each define a rectangular shape. In an exemplary embodiment, the second, third, seventh, and eighth flaps each define the first triangular shape and the first and sixth flaps each define the second triangular shape. In an exemplary embodiment, the second, third, seventh, and eighth flaps each define the first trapezoidal shape and the first and sixth flaps each define the second triangular shape. In an exemplary embodiment, the second, third, seventh, and eighth flaps each define the first triangular shape and the first and sixth flaps each define the second trapezoidal shape. In an exemplary embodiment, the first and sixth flaps each define a first rectangular shape and the fourth, fifth, ninth, and tenth flaps each define a second rectangular shape.

The present disclosure also introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively; wherein the second and third flaps each define a rectangular shape and the first, fourth, and fifth flaps each define a triangular shape. In an exemplary embodiment, the packaging sheet further includes sixth, seventh, eighth, ninth, and tenth flaps connected to the first, second, third, fourth, and fifth panels, respectively, opposite the first, second, third, fourth, and fifth flaps, respectively; wherein the seventh and eighth flaps each define the rectangular shape and the sixth, ninth, and tenth flaps each define the triangular shape.

The present disclosure also introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively, along first, second, third, fourth, and fifth edges, respectively; wherein the second and third flaps each define a distal edge extending at a first angle relative to the second and third edges, respectively. In an exemplary embodiment, the first flap defines a pair of distal edges each extending at a second angle relative to the first edge. In an exemplary embodiment, the second and third flaps each further define another distal edge spaced in a parallel relation with the second and third edges, respectively. In an exemplary embodiment, the first flap further defines another distal edge spaced in a parallel relation with the first edge. In an exemplary embodiment, the fourth and fifth flaps each define a distal edge spaced in a parallel relation with the fourth and fifth edges, respectively. In an exemplary embodiment, the first, fourth, and fifth flaps each define a distal edge spaced in a parallel relation with the first, fourth, and fifth edges, respectively. In an exemplary embodiment, the packaging sheet further includes sixth, seventh, eighth, ninth, and tenth flaps connected to the first, second, third, fourth, and fifth panels, respectively, along sixth, seventh, eighth, ninth, and tenth edges, respectively; wherein the seventh and eighth flaps each define a distal edge extending at the first angle relative to the seventh and eighth edges, respectively. In an exemplary embodiment, the first and sixth flaps each define a pair of distal edges each extending at a second angle relative to the first and sixth edges, respectively. In an exemplary embodiment, the second, third, seventh, and eighth flaps each further define another distal edge spaced in a parallel relation with the second, third, seventh, and eighth edges, respectively. In an exemplary embodiment, the first and sixth flaps each further define another distal edge spaced in a parallel relation with the first and sixth edges, respectively. In an exemplary embodiment, the fourth, fifth, ninth, and tenth flaps each define a distal edge spaced in a parallel relation with the fourth, fifth, ninth, and tenth edges, respectively. In an exemplary embodiment, the first, fourth, fifth, sixth, ninth, and tenth flaps each define a distal edge spaced in a parallel relation with the first, fourth, fifth, sixth, ninth, and tenth edges, respectively.

The present disclosure also introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively, along first, second, third, fourth, and fifth edges, respectively; the first, fourth, and fifth flaps each defining a pair of distal edges each extending at an angle relative to the first, fourth, and fifth edges, respectively, and the second and third flaps each defining a distal edge spaced in a parallel relation with the second and third edges, respectively. In an exemplary embodiment, the packaging sheet further includes sixth, seventh, eighth, ninth, and tenth flaps connected to the first, second, third, fourth, and fifth panels, respectively, along sixth, seventh, eighth, ninth, and tenth edges, respectively; the sixth, ninth, and tenth flaps each defining a pair of distal edges each extending at the angle relative to the sixth, ninth, and tenth edges, respectively, and the seventh and eighth flaps each defining a distal edge spaced in a parallel relation with the seventh and eighth edges, respectively.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and "right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively;

the second and third flaps each defining either a first triangular shape or a first trapezoidal shape;

wherein the fourth and fifth panels are spaced in a substantially parallel relation from the first panel when the packaging sheet wraps the article or object, provides structure around the article or object, or forms the box.

2. The packaging sheet of claim 1, wherein the first flap defines either a second triangular shape or a second trapezoidal shape.

3. The packaging sheet of claim 2, wherein the fourth and fifth flaps each define a rectangular shape.

4. The packaging sheet of claim 2, wherein the second and third flaps each define the first triangular shape and the first flap defines the second triangular shape.

5. The packaging sheet of claim 2, wherein the second and third flaps each define the first trapezoidal shape and the first flap defines the second triangular shape.

6. The packaging sheet of claim 2, wherein the second and third flaps each define the first triangular shape and the first flap defines the second trapezoidal shape.

7. The packaging sheet of claim 1, wherein the first flap defines a first rectangular shape and the fourth and fifth flaps each define a second rectangular shape.

8. The packaging sheet of claim 1, further comprising:

sixth, seventh, eighth, ninth, and tenth flaps connected to the first, second, third, fourth, and fifth panels, respectively, opposite the first, second, third, fourth, and fifth flaps, respectively;

wherein the seventh and eighth flaps each define either the first triangular shape or the first trapezoidal shape.

9. The packaging sheet of claim 8, wherein the first and sixth flaps each define either a second triangular shape or a second trapezoidal shape.

10. The packaging sheet of claim 9, wherein the fourth, fifth, ninth, and tenth flaps each define a rectangular shape.

11. The packaging sheet of claim 9, wherein the second, third, seventh, and eighth flaps each define the first triangular shape and the first and sixth flaps each define the second triangular shape.

12. The packaging sheet of claim 9, wherein the second, third, seventh, and eighth flaps each define the first trapezoidal shape and the first and sixth flaps each define the second triangular shape.

13. The packaging sheet of claim 9, wherein the second, third, seventh, and eighth flaps each define the first triangular shape and the first and sixth flaps each define the second trapezoidal shape.

14. The packaging sheet of claim 8, wherein the first and sixth flaps each define a first rectangular shape and the fourth, fifth, ninth, and tenth flaps each define a second rectangular shape.

15. The packaging sheet of claim 1, wherein the fourth and fifth panels overlap one another when the packaging sheet wraps the article or object, provides structure around the article or object, or forms the box.

16. The packaging sheet of claim 1, wherein the packaging sheet defines a rectangular prism when the packaging sheet wraps the article or object, provides structure around the article or object, or forms the box.

17. The packaging sheet of claim 1, wherein the second and third flaps each define the first triangular shape and the first flap defines a rectangular shape.

18. The packaging sheet of claim 17, further comprising:

sixth, seventh, eighth, ninth, and tenth flaps connected to the first, second, third, fourth, and fifth panels, respectively, opposite the first, second, third, fourth, and fifth flaps, respectively;

wherein the seventh and eighth flaps each define the first triangular shape and the sixth flap defines the rectangular shape.

19. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively;

the second and third flaps each defining a rectangular shape and the first, fourth, and fifth flaps each defining a triangular shape;

wherein the fourth and fifth panels are spaced in a substantially parallel relation from the first panel when the packaging sheet wraps the article or object, provides structure around the article or object, or forms the box.

20. The packaging sheet of claim 19, further comprising:

sixth, seventh, eighth, ninth, and tenth flaps connected to the first, second, third, fourth, and fifth panels, respectively, opposite the first, second, third, fourth, and fifth flaps, respectively;

wherein the seventh and eighth flaps each define the rectangular shape and the sixth, ninth, and tenth flaps each define the triangular shape.

21. The packaging sheet of claim 19, wherein the fourth and fifth panels overlap one another when the packaging sheet wraps the article or object, provides structure around the article or object, or forms the box.

22. The packaging sheet of claim 19, wherein the packaging sheet defines a rectangular prism when the packaging sheet wraps the article or object, provides structure around the article or object, or forms the box.

23. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively, along first, second, third, fourth, and fifth edges, respectively;

the second and third flaps each defining a distal edge extending at a first angle relative to the second and third edges, respectively;

wherein the fourth and fifth panels are spaced in a substantially parallel relation from the first panel when the packaging sheet wraps the article or object, provides structure around the article or object, or forms the box.

24. The packaging sheet of claim 23, wherein the first flap defines a pair of distal edges each extending at a second angle relative to the first edge.

25. The packaging sheet of claim 24, wherein the second and third flaps each further define another distal edge spaced in a parallel relation with the second and third edges, respectively.

26. The packaging sheet of claim 24, wherein the first flap further defines another distal edge spaced in a parallel relation with the first edge.

27. The packaging sheet of claim 24, wherein the fourth and fifth flaps each define a distal edge spaced in a parallel relation with the fourth and fifth edges, respectively.

28. The packaging sheet of claim 23, wherein the first, fourth, and fifth flaps each define a distal edge spaced in a parallel relation with the first, fourth, and fifth edges, respectively.

29. The packaging sheet of claim 23, further comprising:

sixth, seventh, eighth, ninth, and tenth flaps connected to the first, second, third, fourth, and fifth panels, respectively, along sixth, seventh, eighth, ninth, and tenth edges, respectively;

wherein the seventh and eighth flaps each define a distal edge extending at the first angle relative to the seventh and eighth edges, respectively.

30. The packaging sheet of claim 29, wherein the first and sixth flaps each define a pair of distal edges each extending at a second angle relative to the first and sixth edges, respectively.

31. The packaging sheet of claim 30, wherein the second, third, seventh, and eighth flaps each further define another distal edge spaced in a parallel relation with the second, third, seventh, and eighth edges, respectively.

32. The packaging sheet of claim 30, wherein the first and sixth flaps each further define another distal edge spaced in a parallel relation with the first and sixth edges, respectively.

33. The packaging sheet of claim 30, wherein the fourth, fifth, ninth, and tenth flaps each define a distal edge spaced in a parallel relation with the fourth, fifth, ninth, and tenth edges, respectively.

34. The packaging sheet of claim 29, wherein the first, fourth, fifth, sixth, ninth, and tenth flaps each define a distal edge spaced in a parallel relation with the first, fourth, fifth, sixth, ninth, and tenth edges, respectively.

35. The packaging sheet of claim 23, wherein the fourth and fifth panels overlap one another when the packaging sheet wraps the article or object, provides structure around the article or object, or forms the box.

36. The packaging sheet of claim 23, wherein the packaging sheet defines a rectangular prism when the packaging sheet wraps the article or object, provides structure around the article or object, or forms the box.

37. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, fourth, and fifth flaps connected to the first, second, third, fourth, and fifth panels, respectively, along first, second, third, fourth, and fifth edges, respectively;

the first, fourth, and fifth flaps each defining a pair of distal edges each extending at an angle relative to the first, fourth, and fifth edges, respectively, and the second and third flaps each defining a distal edge spaced in a parallel relation with the second and third edges, respectively;

wherein the fourth and fifth panels are spaced in a substantially parallel relation from the first panel when the packaging sheet wraps the article or object, provides structure around the article or object, or forms the box.

38. The packaging sheet of claim 37, further comprising:

sixth, seventh, eighth, ninth, and tenth flaps connected to the first, second, third, fourth, and fifth panels, respectively, along sixth, seventh, eighth, ninth, and tenth edges, respectively;

the sixth, ninth, and tenth flaps each defining a pair of distal edges each extending at the angle relative to the sixth, ninth, and tenth edges, respectively, and the seventh and eighth flaps each defining a distal edge spaced in a parallel relation with the seventh and eighth edges, respectively.

39. The packaging sheet of claim 37, wherein the fourth and fifth panels overlap one another when the packaging sheet wraps the article or object, provides structure around the article or object, or forms the box.

40. The packaging sheet of claim 37, wherein the packaging sheet defines a rectangular prism when the packaging sheet wraps the article or object, provides structure around the article or object, or forms the box.

* * * * *